US007987984B2

(12) United States Patent
Gipson

(10) Patent No.: US 7,987,984 B2
(45) Date of Patent: Aug. 2, 2011

(54) METHOD OF MARKETING FOR ABSORBENT PAPER PRODUCTS THROUGH BRANDED PRINT PACKAGING

(75) Inventor: William Patrick Gipson, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 664 days.

(21) Appl. No.: 11/901,981

(22) Filed: Sep. 20, 2007

(65) Prior Publication Data

US 2008/0072465 A1 Mar. 27, 2008

Related U.S. Application Data

(60) Provisional application No. 60/847,192, filed on Sep. 26, 2006.

(51) Int. Cl.
*B65D 85/00* (2006.01)
*B65D 73/00* (2006.01)

(52) U.S. Cl. ..... 206/494; 40/312; 206/459.5

(58) Field of Classification Search ..... 206/438, 206/440, 441, 459.5, 494; 40/312
See application file for complete search history.

(56) References Cited

U.S. PATENT DOCUMENTS

| | | | | |
|---|---|---|---|---|
| 2,212,397 | A | | 8/1940 | Cardoso et al. |
| 3,677,570 | A | | 7/1972 | Hedu ..... 280/33.992 |
| 3,877,576 | A | | 4/1975 | Kishi et al. |
| 3,910,412 | A | | 10/1975 | Vargo ..... 206/459.5 |
| 3,960,272 | A | | 6/1976 | Hartbauer et al. |
| 3,995,555 | A | | 12/1976 | Stewart ..... 101/227 |
| 4,135,024 | A | | 1/1979 | Callahan et al. ..... 428/171 |
| 4,238,541 | A | | 12/1980 | Burton |
| 4,345,393 | A | | 8/1982 | Price et al. ..... 40/312 |
| 4,377,234 | A | * | 3/1983 | Kaplan ..... 206/432 |
| 4,512,504 | A | | 4/1985 | Owlett ..... 224/572 |
| 5,038,986 | A | | 8/1991 | Beauchesne ..... 224/277 |
| 5,072,956 | A | | 12/1991 | Tannehill et al. ..... 280/33.992 |
| 5,261,531 | A | * | 11/1993 | Nieves ..... 206/205 |
| 5,305,935 | A | | 4/1994 | Weiner ..... 224/277 |
| 5,344,027 | A | | 9/1994 | Kaplan ..... 206/459.5 |
| 5,427,392 | A | | 6/1995 | Duer ..... 280/33.992 |
| 5,445,272 | A | | 8/1995 | Crisp ..... 206/459.5 |
| D377,372 | S | | 1/1997 | Thompson ..... D19/1 |
| 5,810,372 | A | | 9/1998 | Arendt |
| 5,851,352 | A | | 12/1998 | Vinson et al. ..... 162/112 |

(Continued)

FOREIGN PATENT DOCUMENTS

EP 0 727 363 A 8/1996

(Continued)

OTHER PUBLICATIONS

U.S. Appl. No. 11/483,508, filed Jul. 10, 2006, Gillespie, et al.

(Continued)

*Primary Examiner* — Luan K Bui
(74) *Attorney, Agent, or Firm* — Christian M. Best; Betty J. Zea

(57) ABSTRACT

A method of communicating benefits to a consumer of an absorbent paper product, the method having the steps of: producing an absorbent paper product wherein the absorbent paper product includes a primary benefit and packaging the absorbent paper product for retail sale. The packaging includes a primary brand logo that is associated with an absorbent paper product and a secondary brand logo that is associated with a fabric softener.

11 Claims, 1 Drawing Sheet

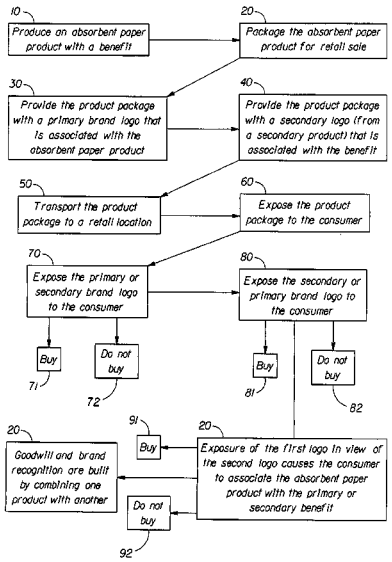

U.S. PATENT DOCUMENTS

| | | | | |
|---|---|---|---|---|
| 6,021,890 | A | 2/2000 | Focke et al. | 206/83.5 |
| 6,065,764 | A | 5/2000 | Moseley | 280/33.992 |
| 6,162,329 | A | 12/2000 | Vinson et al. | 162/158 |
| 6,305,531 | B1 * | 10/2001 | Wilkman | 206/459.5 |
| 6,344,111 | B1 | 2/2002 | Wilhelm | |
| D457,764 | S | 5/2002 | Ong | |
| 6,440,268 | B1 | 8/2002 | Baggot et al. | |
| 6,454,095 | B1 | 9/2002 | Brisbois et al. | |
| 6,601,705 | B2 | 8/2003 | Molina et al. | 206/494 |
| 6,631,574 | B2 | 10/2003 | Okyere | 40/309 |
| 6,648,864 | B2 | 11/2003 | Ronn et al. | 604/385.01 |
| 6,821,387 | B2 | 11/2004 | Hu | 162/129 |
| 6,893,535 | B2 | 5/2005 | Hermans et al. | |
| 6,966,971 | B1 | 11/2005 | Sellars et al. | |
| 7,029,121 | B2 | 4/2006 | Edwards | |
| 7,172,073 | B2 | 2/2007 | Hanson | 206/459.5 |
| 7,208,429 | B2 | 4/2007 | Vinson et al. | |
| 7,281,344 | B2 | 10/2007 | Knauf | 40/649 |
| 7,281,718 | B2 | 10/2007 | Malchow | 280/33.992 |
| 7,374,638 | B2 | 5/2008 | Horenziak et al. | 162/109 |
| 7,621,397 | B2 | 11/2009 | Boudrie et al. | 206/391 |
| 7,803,249 | B2 | 9/2010 | Dyer et al. | 162/168.1 |
| 2002/0050085 | A1 | 5/2002 | Durham | |
| 2003/0201085 | A1 | 10/2003 | Vinson et al. | 162/204 |
| 2004/0099389 | A1 | 5/2004 | Chen et al. | 162/134 |
| 2004/0165944 | A1 * | 8/2004 | Varanese et al. | 403/266 |
| 2004/0200752 | A1 | 10/2004 | Poli | |
| 2004/0216339 | A1 | 11/2004 | Garberg et al. | |
| 2005/0033630 | A1 | 2/2005 | Kowalchuk | |
| 2005/0065492 | A1 | 3/2005 | Cole et al. | |
| 2005/0121347 | A1 | 6/2005 | Hanson | |
| 2005/0173281 | A1 | 8/2005 | Goodall et al. | |
| 2005/0218612 | A1 | 10/2005 | Malchow | |
| 2005/0275800 | A1 | 12/2005 | Krombholz et al. | |
| 2005/0279579 | A1 | 12/2005 | Milk et al. | 186/52 |
| 2006/0069372 | A1 | 3/2006 | Chakravarty et al. | 604/385.02 |
| 2006/0113049 | A1 | 6/2006 | Knobloch et al. | 162/117 |
| 2006/0144736 | A1 | 7/2006 | Goodrich et al. | |
| 2006/0168914 | A1 | 8/2006 | Steeves-Kiss et al. | |
| 2006/0173734 | A1 | 8/2006 | Brandt | 705/14 |
| 2006/0271427 | A1 * | 11/2006 | Raimondo | 705/14 |
| 2006/0278550 | A1 * | 12/2006 | Cipriani | 206/459.5 |
| 2006/0288619 | A1 | 12/2006 | Henke et al. | |
| 2007/0043615 | A1 | 2/2007 | Dahleh et al. | |
| 2007/0055573 | A1 | 3/2007 | Grell | |
| 2007/0061188 | A1 | 3/2007 | Sakemiller et al. | |
| 2007/0095706 | A1 * | 5/2007 | Legault et al. | 206/459.5 |
| 2007/0100692 | A1 | 5/2007 | Minifie et al. | |
| 2007/0156515 | A1 | 7/2007 | Hasselback et al. | |
| 2007/0193899 | A1 * | 8/2007 | Weber et al. | 206/459.5 |
| 2007/0235263 | A1 | 10/2007 | Legault et al. | |
| 2008/0051750 | A1 | 2/2008 | Schagen et al. | |
| 2008/0078685 | A1 | 4/2008 | Patterson et al. | |
| 2008/0097364 | A1 | 4/2008 | Yang | 604/385.02 |
| 2008/0202954 | A1 | 8/2008 | Knobloch et al. | |
| 2008/0202964 | A1 | 8/2008 | Knobloch et al. | |
| 2008/0202965 | A1 | 8/2008 | DuVal et al. | |
| 2008/0202968 | A1 | 8/2008 | Knobloch et al. | |
| 2008/0245491 | A1 | 10/2008 | Knobloch et al. | |
| 2008/0245693 | A1 | 10/2008 | Vinson | |
| 2008/0319848 | A1 * | 12/2008 | Starr et al. | 206/459.5 |

FOREIGN PATENT DOCUMENTS

| | | | |
|---|---|---|---|
| EP | 0 979 781 | A | 2/2000 |
| FR | 2 869 597 | A | 11/2005 |
| GB | 658 841 | A | 10/1951 |
| GB | 1499146 | | 1/1978 |
| WO | WO 98/47130 | A1 | 10/1998 |
| WO | WO 01/88885 | A | 11/2001 |
| WO | WO 2006/083591 | A1 | 8/2006 |
| WO | WO 2006/130284 | A1 | 12/2006 |

OTHER PUBLICATIONS

U.S. Appl. No. 11/897,767, filed Aug. 31, 2007, Wiwi, et al.
U.S. Appl. No. 11/897,768, filed Aug. 31, 2007, Knobloch, et al.
U.S. Appl. No. 11/897,806, filed Aug. 31, 2007, Roetker, et al.
U.S. Appl. No. 11/899,227, filed Sep. 7, 2007, Duval, et al.
U.S. Appl. No. 11/899,228, filed Sep. 5, 2007, Duval, et al.
U.S. Office Action, U.S. Appl. No. 11/897,777, mailed Jul. 8, 2009.
U.S. Office Action, U.S. Appl. No. 11/897,777, mailed Dec. 15, 2009.
U.S. Office Action, U.S. Appl. No. 11/897,766, mailed Jun. 18, 2009.
U.S. Office Action, U.S. Appl. No. 11/897,766, mailed Dec. 16, 2009.
U.S. Office Action, U.S. Appl. No. 11/897,766, mailed Mar. 24, 2010.
U.S. Office Action, U.S. Appl. No. 11/897,766, mailed Sep. 1, 2010.
U.S. Office Action, U.S. Appl. No. 11/897,766, mailed Dec. 7, 2010.
U.S. Office Action, U.S. Appl. No. 11/897,852, mailed Jul. 7, 2009.
U.S. Office Action, U.S. Appl. No. 11/897,852, mailed Jan. 26, 2010.
U.S. Office Action, U.S. Appl. No. 11/897,852, mailed Apr. 23, 2010.
U.S. Office Action, U.S. Appl. No. 11/897,852, mailed Oct. 5, 2010.
U.S. Office Action, U.S. Appl. No. 11/897,768, mailed Dec. 16, 2010.
U.S. Office Action, U.S. Appl. No. 11/899,227, mailed Jul. 7, 2009.
U.S. Office Action, U.S. Appl. No. 11/899,227, mailed Jan. 11, 2010.
U.S. Office Action, U.S. Appl. No. 11/899,227, mailed May 13, 2010.
U.S. Office Action, U.S. Appl. No. 12/061,816, mailed Apr. 14, 2009.
U.S. Office Action, U.S. Appl. No. 12/061,816, mailed Nov. 13, 2009.
U.S. Office Action, U.S. Appl. No. 12/061,816, mailed Mar. 9, 2010.
U.S. Office Action, U.S. Appl. No. 12/061,816, mailed Sep. 15, 2010.
U.S. Office Action, U.S. Appl. No. 11/897,806, mailed Jul. 15, 2009.
U.S. Office Action, U.S. Appl. No. 11/897,806, mailed Dec. 15, 2009.
U.S. Office Action, U.S. Appl. No. 11/897,767, mailed Nov. 22, 2010.
Action Figure; Stretch X-Ray, Kenner, Original Box; Year:1979 http://www.prices4 antiques.com/toys/action-figures/Action-Figure-Stretch-X-Ray-Kenner-Original-Box-D9953158.htm.
Brawny, Paper Towels, Pick-a-Size Big Roll, Jan. 1, 2005 <http://web.archive.org/web/20050506071433/http://www.drugstore.com>.
Cashmere, Premium quality bathroom tissue, Jan. 1, 2006 <http://web.archive.org/web/20061027025443/cashmere.ca/index.php>.
Charmin, Bathroom Tissue, Ultra, Double Roll, Jan. 1, 2005, Angel Soft, Unscented Bathroom Tissue, Jan. 10, 2005 <http://web.archive.org.web/2005067/http://www.drugstore.com/>.
The Impact of Ad Background color on Brand Personality and Brand Preferences; Luz M. Gonzalez; May 2006.
All Office Actions in U.S. Appl. Nos. 11/483,508; 11/897,767; 11/897,768; 11/897,806; 11/899,227; and 11/899,228.
International Search Report and Written Opinion (PCT WO 2008/007341); U.S. Appl. No. 11/11/483,508 (now abandoned)).

* cited by examiner

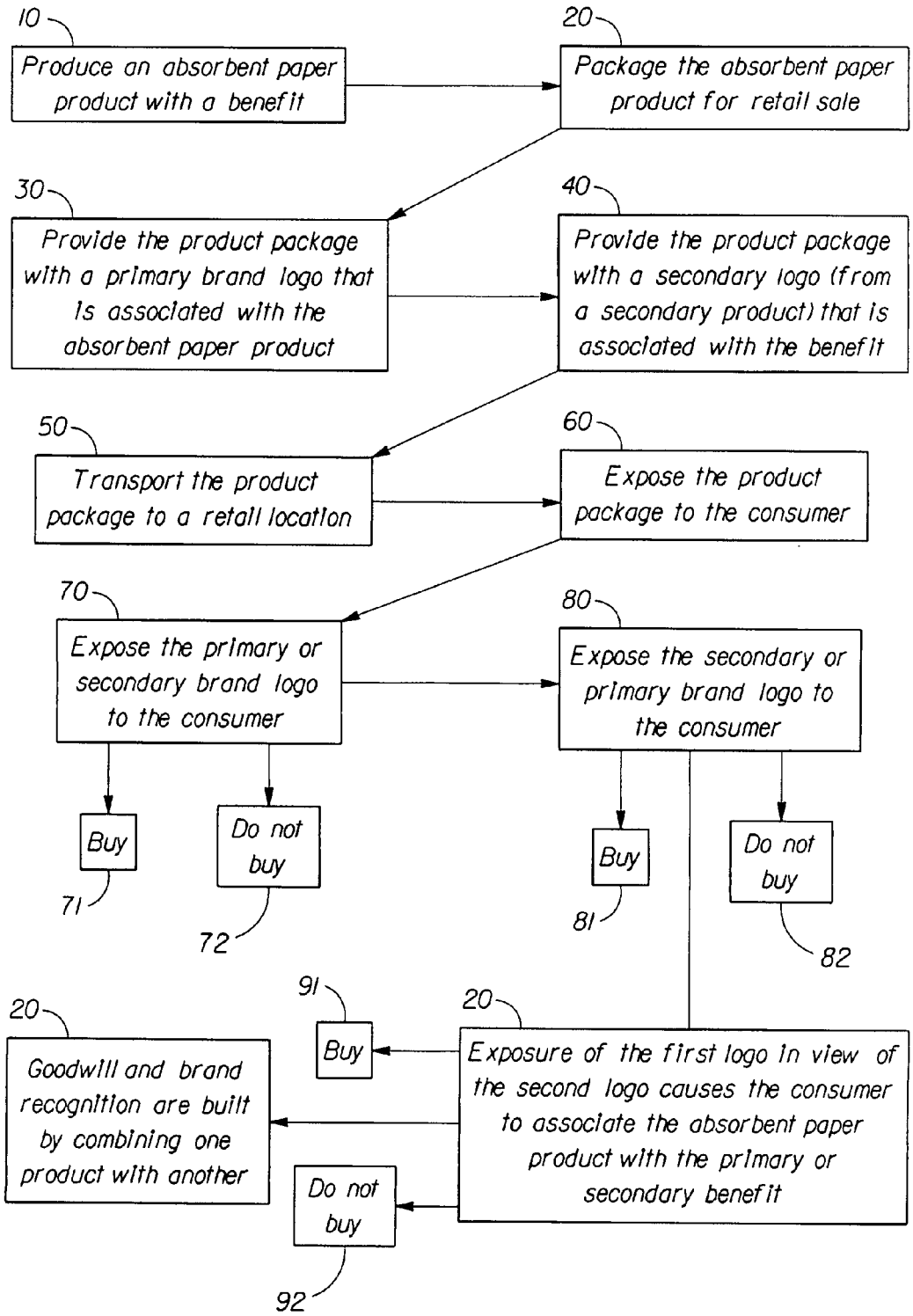
10
Produce an absorbent paper product with a benefit
20
Package the absorbent paper product for retail sale
30
Provide the product package with a primary brand logo that is associated with the absorbent paper product
40
Provide the product package with a secondary logo (from a secondary product) that is associated with the benefit
50
Transport the product package to a retail location
60
Expose the product package to the consumer
70
Expose the primary or secondary brand logo to the consumer
80
Expose the secondary or primary brand logo to the consumer
Buy
71
Do not buy
72
Buy
81
Do not buy
82
20
Goodwill and brand recognition are built by combining one product with another
91
Buy
20
Exposure of the first logo in view of the second logo causes the consumer to associate the absorbent paper product with the primary or secondary benefit
Do not buy
92

METHOD OF MARKETING FOR ABSORBENT PAPER PRODUCTS THROUGH BRANDED PRINT PACKAGING

CROSS REFERENCE TO RELATED APPLICATIONS

This application claims the benefit of U.S. Provisional Application No. 60/847,192, filed Sep. 26, 2006.

FIELD OF THE INVENTION

This invention is a business method, specifically, a business method of marketing absorbent paper products through the use of multiple brand logos on the product packaging wherein at least one of the brand logos (the secondary brand logo) is used for a different product than an absorbent paper product. The secondary brand logo communicates to consumers either an enhanced benefit of the absorbent paper product or some additional benefit to the absorbent paper product.

BACKGROUND OF THE INVENTION

Product packaging impacts product visibility to the customer and consequently impacts revenues derived for product sales. Because of this relationship, manufacturers and retailers have a vested interest in displaying product packages that have the most effective communication indicia as is possible. That being said, providing effective communicative indicia on the product packages may provide obstacles for a manufacturer. For instance, without wishing to be limited by theory, it is thought that a major obstacle to manufacturers' is providing consumers with product packaging having communicative indicia that does not take up an unduly large amount of surface area, but which effectively conveys the manufacturers' intended message.

Some products have certain qualities or benefits already associated with them. For example, family care products, such as absorbent paper products, feminine care products, baby care products, and household care products are all known to perform particular functions and to have certain qualities. In addition to considering primary (well-known) benefits associated with a product, a consumer may also consider secondary benefits that are not normally associated with the product. In many instances, a consumer will consider enhanced primary or secondary benefits of the product when deciding which product to purchase. Some products which contain such enhanced primary or secondary benefits are packaged such that the text printed on the product packaging touts the improved features. However, packaging for prior art family care products, particularly absorbent paper products, tends to use a vast amount of text to convey primary and secondary benefits to consumers. The text tends to be distracting to the overall visual effect of the packaging and does not take full advantage of the space on the product packaging that it is printed on. It is often the case that the text that conveys the message is generic in form and does not separate itself from other packages in the retail space which may have similar messages. This being the case, the overall impact of such indicia on the product package may be dramatically reduced.

Thus, there exists the need for a method of doing business that provides the consumers with a product package that includes indicia that effectively, but simply communicates specific primary and secondary benefits to the consumer such that a minimal surface area of the product package is occupied in conveying the benefits. It is known that an average consumer has certain preconceived notions regarding the benefits of a product depending on the brand of product that is being sold.

Thus, a feasible solution to this problem is to take advantage of a brand logo or brand name of a product that is different from the brand of the primary product being sold. In other words, it is possible to associate the benefits that are known to a different type of product to highlight an existing benefit or to showcase a new benefit altogether for an absorbent substrate type of product.

SUMMARY OF THE INVENTION

The present invention provides a method of communicating benefits to a customer of an absorbent paper product, the method comprising the steps of: (i) producing an absorbent paper product, wherein the absorbent paper product comprises a benefit; (ii) packaging the absorbent paper product for retail sale, wherein the packaging comprises: (a) a primary brand logo, wherein the primary brand logo is associated with an absorbent paper product, and (b) a secondary brand logo, wherein the secondary brand logo is associated with a fabric softener.

In another embodiment, the present invention relates to packaging for a method of communicating benefits to a consumer of an absorbent paper product, the packaging comprising: (i) a primary brand logo, wherein the primary brand logo is associated with an absorbent paper product, and (ii) a secondary brand logo, wherein the secondary brand logo is associated with a fabric softener.

BRIEF DESCRIPTION OF THE DRAWINGS

The following detailed description of specific embodiments of the present invention can be best understood when read in conjunction with the following drawings, where like structures are indicated with like reference numerals and in which:

FIG. 1 is a flow diagram that illustrates one embodiment of the method of marketing as may utilize the present invention.

DETAILED DESCRIPTION OF THE INVENTION

As defined herein, "product packaging" refers to the outer wrap or container in which the consumer product is held while in the retail space.

As defined herein, "primary product" refers to the major product being sold. In one embodiment, a primary product is an absorbent paper product. Exemplary paper products include, but are not limited to: paper towels, sanitary tissue paper, napkins, the like, and combinations thereof. Similarly, "secondary product" refers to a product other than the primary product which may provide an actual or perceived benefit to the primary product. In one embodiment, a secondary product is a fabric softener. A fabric softener is a product that may be used during the laundering of fabrics and textiles to enhance the tactile qualities and softness of the fabrics and textiles. Fabric softeners that can be used herein are disclosed in U.S. Pat. Nos. 3,861,870, 4,308,151, 3,886,075, 4,233,164, 4,401,578, 3,974,076, and 4,237,016. Exemplary embodiments of fabric softening agents are disclosed in U.S. Pat. No. 4,661,269. An example of a fabric softener is the Downy™ brand fabric softener produced by the Procter & Gamble Company (Cincinnati, Ohio).

As defined herein, "benefit" refers to a quality that is associated with a product during its normal use, or to a quality that is not normally associated with a product, but which the product may possess nonetheless. In an embodiment, primary benefits of an absorbent paper product may include, but are not limited to: texture, absorbency, softness, caliper, biodegradability, hygiene, anti-microbial benefits, luxury, scent, moisturizing qualities, strength, and combinations thereof.

As defined herein, "primary brand logo" refers to the brand name or brand logo that is normally associated with the primary product being sold. Similarly, "secondary brand logo" refers to the brand name or brand logo that is associated with a secondary product.

As defined herein, "communicative indicia" refers to any indicia that can communicate a specific primary or secondary benefit. Communicative indicia includes, but is not limited to: brands, logos, brand logos, brand names, words, symbols, pictures, trademarks, graphics, text, product samples, advertising information, letters, messages, and combinations thereof.

As defined herein, "absorbent paper product" refers to any formed, fibrous structure paper products, traditionally, but not necessarily, are used for drying cleaning, and wiping purposes. Absorbent paper products comprise paper making fibers. Absorbent paper products include products such as paper towels, facial tissues, sanitary tissues, and the like.

The absorbent paper product may comprise a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl, alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded. Other materials are also intended to be within the scope of the present invention as long as they do not interfere or counteract any advantage presented by the instant invention.

The absorbent paper products may comprise any tissue-towel paper product known in the industry. Exemplary embodiments of these absorbent paper products may be made according U.S. Pat. Nos. 4,191,609, 4,300,981, 4,191,609, 4,514,345, 4,528,239, 4,529,480, 4,637,859, 5,245,025, 5,275,700, 5,328,565, 5,334,289, 5,364,504, 5,527,428, 5,556,509, 5,628,876, 5,629,052, 5,637,194 and 5,411,636; European Patent Nos. EP 677612; and U.S. Pat. App. No. 2004/0192136A1.

The absorbent paper products may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. Nos. 6,048,938, 5,942,085, 5,865,950, 4,440,597, 4,191,756 and 6,187,138.

Methods for making such absorbent paper products are known in the art. For example, U.S. Pat. No. 6,547,928. One suitable absorbent paper product is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified tissue webs are disclosed in U.S. Pat. Nos. 3,301,746, 3,974,025, 4,191,609, 4,637,859, 3,301,746, 3,821,068, 3,974,025, 3,573,164, 3,473,576, 4,239,065 and 4,528,239.

Uncompacted, non pattern-densified absorbent paper products are also contemplated within the scope of the present invention and are described in U.S. Pat. Nos. 3,812,000 and 4,208,459. Uncreped tissue paper as defined in the art are also contemplated. The techniques to produce uncreped tissue in this manner are taught in the prior art. For example, Wendt, et al. in European Patent Application Nos. 0 677 612A2 and 0 617 164 A1; and U.S. Pat. No. 5,656,132.

The present invention relates to a method of doing business that provides consumers with a product package which effectively presents communicative indicia to inform consumers of a benefit associated with that product.

If the absorbent paper product is to perform its intended task and to find wide acceptance, it must provide the consumer with benefits. Benefits include, but are not limited to, the group consisting of: texture, absorbency, softness, caliper, biodegradability, hygiene, anti-microbial benefits, luxury, scent, moisturizing qualities, strength, and combinations thereof. Texture is the visual or tactile surface characteristics and appearance of the absorbent paper product. Absorbency is the characteristic of the paper web that facilitates the take up and retention of fluids, particularly water, aqueous solutions, and suspensions. In addition, the absolute quantity of a fluid that a fixed amount of an absorbent paper product will hold, and the rate at which a fixed amount of an absorbent paper product web will absorb the fluid are also primary benefits of an absorbent paper product. Softness is a pleasing tactile sensation the user perceives as the paper is crumpled in their hand and is contacted to various portions of the anatomy. Caliper is the thickness of the absorbent paper product. Biodegradability is the tendency of the paper to be broken down into innocuous products by the action of micro-organisms. Hygiene is the ability of the product to perform functions that are conducive to health or cleanliness. Anti-microbial benefits include the ability of the product to remove or reduce the presence of harmful micro-organisms. Luxury is the adding of pleasure, comfort, satisfaction, or ease but not being necessary. Scent refers to the effluvia from a substance that affect the sense of smell. Moisturizing qualities refer to the ability of the product to impart lotion or other skin-benefiting agents onto the user. Strength is the ability of a paper web to retain its physical integrity during use.

In one embodiment, the product package contains absorbent paper products. The product package further comprises one or more communicative indicium that informs consumers of benefits associated with the product. In an embodiment of the invention, the communicative indicium is a secondary logo of a secondary product. Specifically, the secondary product may be associated by consumers with a desirable quality, or benefit, not normally associated with the primary product.

FIG. 1 is flow chart illustrating the steps of an embodiment of the present business method of providing a product package with simple and concise communicative indicia on the product packaging. Referring to FIG. 1, an absorbent paper product is produced with a benefit 10. In certain embodiments of the present invention, the benefit is a benefit that exists in the absorbent paper product as it is produced. In other embodiments, the benefit is an enhancement to the qualities of an ordinary absorbent paper product. In one embodiment, the benefit is introduced during the production of the absorbent paper product. In a different embodiment, the benefit is introduced after the production of the absorbent paper product. The benefit can be applied directly to the paper web of the absorbent paper product, but in some embodiments, a benefit can be applied to the core of the absorbent paper product. The absorbent paper product is then packaged for retail sale 20. The product package is provided with a primary logo that is associated by consumers with the absorbent paper product 30. For example, if the product package contains a primary brand, BRAND X, of absorbent paper products, then the logo will have indicia that is associated by text, graphics, or some combination thereof to BRAND X. The product package is also provided with the secondary logo from a secondary product that is different from, and not normally associated with, the primary product, but which is associated to the benefit 40. For example, if the absorbent paper product has been given either an enhanced, or an additional, QUALITY Z and QUALITY Z is normally associated with BRANDY, then the product package will be printed with the logo of BRAND Y. This conveys to consumers that the absorbent paper product has QUALITY Z based on the endorsement, or presence, of the BRAND Y (secondary brand) logo. The primary and secondary logos can be applied to the packaging at any time during the manufacturing and packaging process. The primary and secondary logos can be printed anywhere on the product packaging and either the primary or the secondary brand logo can be the prevalent logo on the product packaging. In one embodiment, there are more than two logos on the product package that associate with secondary benefits.

Referring back to FIG. 1, the product package is transported to a retail location 50 and is exposed to the consumer 60. Either the primary or the secondary brand logo is exposed to the consumer 70, and depending on the consumer's perception of that brand, the consumer may either buy 71, or not buy 72, the product based on viewing of the primary or the secondary brand logo alone. If the consumer does not decide to buy the product based on the first logo alone (primary or secondary brand logo), the next logo (second or primary brand logo, depending on whether the primary or the secondary brand logo was the logo viewed in 70) is exposed to the consumer 80 and the consumer may either buy 81, or not buy 82, the product based on viewing of the next logo (secondary or primary brand logo or primary logo) alone. If the consumer does not decide to buy the product based on the next logo alone, the consumer may consider the brand associated with the primary brand logo in view of the brand of the secondary brand logo and associate benefits from one brand to the other 90, and either buy 91, or not buy 92, the product. For example, if the primary brand logo conveys an absorbent paper product of exceptional strength and absorbency, and the secondary brand logo conveys pleasant scents and/or softness, then the consumer may understand the product packaging to imply that the absorbent paper product is strong, absorbent, fragrant, and soft. If the consumer buys the product based on viewing the two brands together 91, then goodwill and improved brand recognition is built by combining the two products together 100.

It is noted that terms like "specifically," "preferably," "typically", "generally", and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package comprising:

a plurality of rolls of absorbent paper products positioned within the package;

a primary brand logo on an external portion of the package, wherein the primary brand logo is associated with the rolls of absorbent paper products; and a secondary brand logo on the external portion of the package, wherein the secondary brand logo is associated with a fabric softener.

2. The package of claim 1 wherein the primary brand logo and the secondary brand logo are used in commerce by and are under the control of the same entity.

3. The package of claim 1 wherein the primary brand logo conveys a first product benefit to a consumer, wherein the secondary brand logo conveys a second product benefit to the consumer, and wherein the first product benefit is different than the second product benefit.

4. The package of claim 1 wherein the rolls of absorbent paper products are one of paper towels and sanitary tissue.

5. A package comprising:

a plurality of rolls of absorbent paper products positioned within the package;

a primary brand logo on the package, wherein the primary brand logo is associated with the rolls of absorbent paper products and is configured to convey a first product benefit to a consumer; and a secondary brand logo on the package, wherein the secondary brand logo is associated with a fabric softener and is configured to convey a second product benefit to the consumer, wherein the first product benefit is different than the second product benefit, and wherein the primary brand logo and the secondary brand logo are owned by the same entity.

6. The package of claim 5 wherein the rolls of absorbent paper products are one of paper towels and sanitary tissue.

7. The package of claim 5 wherein the secondary brand logo is more prevalent on the package than the primary brand logo.

8. The package of claim 5 wherein the plurality of absorbent paper products do not comprise wipes.

9. A package comprising:

a plurality of rolls of absorbent paper products positioned within the package;

a primary brand logo on the package, wherein the primary brand logo is associated with the rolls of absorbent paper products and is configured to convey a first product benefit to a consumer; and a secondary brand logo on the package, wherein the secondary brand logo is associated with a fabric softener and is configured to convey a second product benefit to the consumer, and wherein the first product benefit is different than the second product benefit.

10. The package of claim 9 wherein the rolls of absorbent paper products are one of paper towels and sanitary tissue.

11. The package of claim 9, wherein the primary brand logo and the second brand logo are both on an external portion of the package.

* * * * *